United States Patent [19]

Scheuter

[11] Patent Number: 4,969,609

[45] Date of Patent: Nov. 13, 1990

[54] WINDING MACHINE FOR PAPER OR CARDBOARD WEBS

[75] Inventor: Siegbert Scheuter, Herbrechtingen, Fed. Rep. of Germany

[73] Assignee: J. M. Voith GmbH, Heidenheim, Fed. Rep. of Germany

[21] Appl. No.: 426,051

[22] Filed: Oct. 24, 1989

[30] Foreign Application Priority Data

Oct. 26, 1988 [DE] Fed. Rep. of Germany ..... 3836367

[51] Int. Cl.[5] ..... B65H 18/20; B65H 18/26

[52] U.S. Cl. ..... 242/66; 242/65; 73/862.55

[58] Field of Search ..... 92/5 L, 10, 24; 242/99, 242/65, 66; 73/862.38, 862.55, 862.62, 862.64; 464/180

[56] References Cited

U.S. PATENT DOCUMENTS

| | | | |
|---|---|---|---|
| 3,182,959 | 5/1965 | Hemmeter | 92/10 X |
| 4,095,755 | 6/1978 | Snygg et al. | 242/66 |
| 4,289,022 | 10/1981 | Dybel et al. | 73/862.64 |
| 4,305,264 | 12/1981 | Mim | 464/180 X |
| 4,334,718 | 6/1982 | Hirt et al. | 464/180 X |
| 4,392,681 | 7/1983 | Raquet | 464/180 |
| 4,458,853 | 7/1984 | Heymanns | 242/66 X |
| 4,484,717 | 11/1984 | Goldstein | 242/99 X |
| 4,486,917 | 12/1984 | Johnston et al. | 92/10 X |
| 4,718,615 | 1/1988 | Hefti et al. | 242/18 DD |
| 4,779,513 | 10/1988 | Kimura | 92/5 L |

FOREIGN PATENT DOCUMENTS

| | | | |
|---|---|---|---|
| 130883 | 1/1985 | European Pat. Off. | 464/180 |
| 582418 | 11/1977 | U.S.S.R. | 464/180 |
| 1059319 | 1/1981 | U.S.S.R. | 464/180 |

*Primary Examiner*—Joseph J. Hail, III
*Assistant Examiner*—Joseph A. Rhoa
*Attorney, Agent, or Firm*—Jeffers, Hoffman & Niewyk

[57] ABSTRACT

A winding machine has at least one roll, against which a winding reel is supported. A guide carriage is connected to the respective end of a core of the winding reel. On said guide carriage acts a thrust motor, the force of said motor controlling the line pressure between the reel and the roll and being determined by a dynamometer. A friction brake is also provided to dampen vibrations of the winding reel, which is arranged to act on the thrust motor, while the dynamometer is located between the thrust motor having the brake and the guide carriage so as to monitor the force actually acting on the carriage, to enable the profile of the line pressure to be controlled by a winding hardness controller.

8 Claims, 1 Drawing Sheet

WINDING MACHINE FOR PAPER OR CARDBOARD WEBS

BACKGROUND OF THE INVENTION

The invention relates to a winding machine for web material, such as paper or cardboard webs, of the kind comprising at least one roll, against which a winding reel is supported, a guide carriage connected to each respective end of a core of the winding reel, a thrust motor acting on the guide carriage, the force of said motor controlling the line pressure between the reel and the roll and being detected by a dynamometer, and a friction brake for damping vibrations of the winding reel.

The web material is wound onto such winding machines at high velocity. Non-circularity of and imbalances in the winding reel result in strong vibrations in the guide carriages acting on both sides of the winding reel. Consequently friction brakes were installed in the guide carriages to dampen the vibrations. These brakes act on guides of winding frames, on which the carriages are guided during the winding operation. Thrust motors act upon the guide carriages, and, with an increase in the diameter of the winding reel, they relieve the roll, against which the winding reel is supported, from a part of the winding weight. The extent by which this weight is relieved is controlled during the winding operation so that the winding hardness to be produced in the winding reel is influenced above the level of the line pressure effective between the winding reel and the roll. Therefore a dynamometer is provided to detect the force of the thrust motors acting on the winding reel. However in the known winding machines not only the force of the thrust motors acting on the guide carriages, but also the braking forces caused by the brakes are measured when the friction brakes become effective. Therefore it is not possible to control the line pressure accurately because of changes in friction on the guides of the carriages.

SUMMARY OF THE INVENTION

The object of the invention is to improve the accuracy of the measurement of the pressure-relieving force of the thrust motors acting on the winding reel. This object is achieved by the features of the present invention wherein the friction brake acts on the thrust motor, while the dynamometer is disposed between the thrust motor and the guide carriage of the winding reel.

The achievement of this object is advantageous inasmuch as the dynamometer measures the magnitude of the relieving force actually acting on the guide carriage and consequently on the winding reel.

The above-mentioned features and further refinements of the invention are explained in more detail below in an exemplified embodiment by reference to the drawings.

DESCRIPTION OF THE PREFERRED EMBODIMENT

Figure 1:
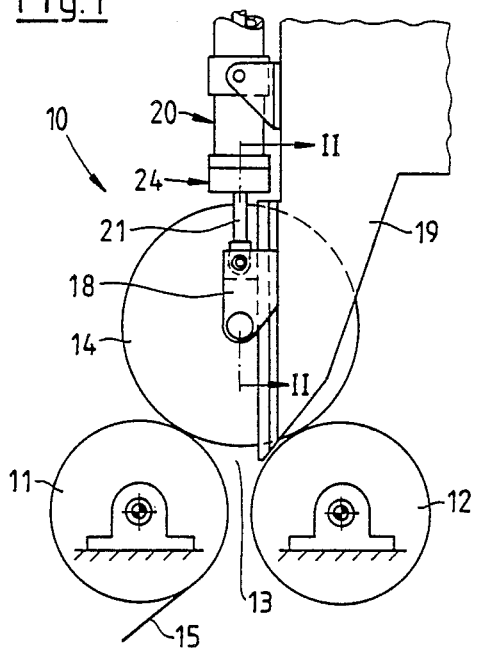
FIG. 1 shows a diagrammatic representation of a winding machine with a thrust motor acting upon a guide carriage for the winding reel.
Figure 2:
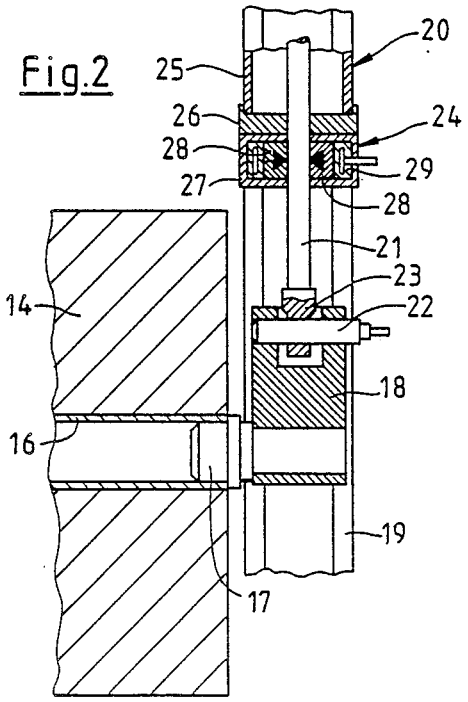
FIG. 2 shows a section along line II-II of FIG. 1 through the thrust motor with a braking mechanism, the guide carriage and a section of the winding reel.

Referring to FIGS. 1 and 2, a winding machine 10 for webshaped material, e.g. paper, has two driven support rolls 11 and 12 disposed parallel to one another, which form a winding bed 13 for a winding reel 14 in its upper wedge (FIG. 1). A paper web 15 travels from underneath and is partially wound around support roll 11 and then travels into the winding bed 13 and then onto the winding reel 14.

The winding reel 14 supported on both support rolls 11 and 12 has a core 16, in which one grip 17 engages at each end (FIG. 2). A guide carriage 18 is connected to the core 16 via grip 17, and said guide carriage 18 is guided vertically on a winding frame 19 disposed on the front end next to the winding reel 14. A pneumatic thrust motor 20 acts from above upon the guide carriage 18 with its piston rod 21. A force measuring bolt 22 of a dynamometer extending at right angles to the axis of the piston rod is provided as a connection between the thrust motor 20 and the guide carriage 18. The force measuring bolt 22 seated on the end section of guide carriage 18 on the side of the thrust motor penetrates an eye 23 on the free end of the piston rod 21. The thrust motor 20 is supported on the winding frame 19, which is in turn connected to the machine frame of the winding machine 10 (not shown). A friction brake 24 acting on the thrust motor 20 is also provided.

The friction brake 24 is disposed at the front end on the cylinder 25 of the thrust motor 20, and includes a housing 27 attached to the cylinder head 26 on the side of the guide carriage. Inside the housing 27 there are several brake shoes 28 disposed around the piston rod 21. These are displaceably guided in the housing 27 radially to the longitudinal axis of the piston rod 21. To actuate them a pressure hose 29 is provided in the housing 27, and it acts on the side of the brake shoes 28 remote from the piston rod 21. The pressure hose 29, which can expand under the effect of a pressure medium, preferably compressed air, presses the brake shoes 28 in the direction of the arrows towards the piston rod 21 of the thrust motor 20. As a modification of this exemplified embodiment, the friction brake 24 may also be integrated in the cylinder head 26 of the thrust motor 20, i.e. the housing 27 of friction brake 24 and the cylinder head 26 of thrust motor 20 form one component.

The components of winding machine 10 described above, namely the grip 17, the guide carriage 18, the winding frame 19, the thrust motor 20, the force measuring bolt of the dynamometer and the friction brake 24 are provided in a corresponding arrangement on both ends of the winding reel 14. Its mode of operation is described below.

During the winding operation, as the size of the winding reel 14 increases, its weight and consequently the line pressure of the reel on the support rolls 11 and 12 increases. In this case the line pressure assumes a magnitude which results in an unfavorable profile of the winding hardness in the winding reel. An upwardly directed force, which is transmitted by the piston rod 21, the force measurement bolt 22, the guide carriage 18 and the grip 17 to the winding reel 14, is produced by the pressure loading of both thrust motors 20. With this force one part of the weight force of winding reel 14 acting on the support rolls 11 and 12 and also the constant weight force caused by the guide carriage 18 with grip 17 is compensated. This relieving force is measured by the magnitude from the force measurement bolt 22 of the dynamometer acting on the guide carriage 18. The relieving force and consequently the line pressure are controlled during the further course of the winding operation by the corresponding pressure loading of the thrust motors 20.

As soon as vibrations in the guide carriage 18 occur as a result of deviations in shape and imbalance in winding reel 14, the friction brakes 24 on both thrust motors 20 are made effective by the pressure loading of pressure hose 29. The brake shoes 28 of friction brake 24 pressed as a result against the piston rod 21 produce braking forces acting in the longitudinal direction of piston rod 21 which dampen the vibrations. These braking forces are counteracted by loading the thrust motors 20 with correspondingly modulated pressure, so as to maintain the magnitude of the force acting on the guide carriage 18 to relieve support rolls 11 and 12 from the winding weight, and consequently the line pressure, at the level preset by the control. In this case the dynamometer on the force measuring bolt 22 detects the relieving force actually acting on the guide carriage 18 even during the vibration damping operation.

The friction brakes 24 may be components in a control loop, in which the vibration of the guide carriage 18 is detected with respect to the amplitude and frequency and the effect of the brakes is adapted by appropriately controlled pressure loading of the pressure hose 29. The pressure loading of the thrust motor 20 can follow the profile of the braking force, which is dependent on the vibrations.

The above-described arrangement of the friction brakes may also be used in winding machines with only one roll, so called support roll winding machines, in which the winding reel is supported on the upper peripheral half of the roll.

What is claimed is:

1. A winding machine for winding web material into a winding reel on a core, said winding machine comprising:

at least one roll supporting said winding reel;

a guide carriage connected to a respective end of the core of the winding reel;

thrust means for controlling line pressure between the winding reel and said roll, said thrust means including a thrust motor exerting force on the guide carriage;

dynamometer means for detecting line pressure between the winding reel and said roll, said dynamometer means being connected between the thrust motor and said guide carriage; and friction brake means for damping vibrations of the winding reel, said friction brake means acting on said thrust motor.

2. A winding machine as claimed in claim 1, in which said thrust motor includes a piston and cylinder, said friction brake means acts on the piston rod of the thrust motor, and said dynamometer means is constructed as a force measurement pin disposed on the guide carriage, with the piston rod of said thrust motor acting on the force measurement pin.

3. A winding machine as claimed in claim 2, in which said friction brake is disposed at a front end of the winding reel on the cylinder of the thrust motor.

4. A winding machine as claimed in claim 3, in which said friction brake includes brake means shoes which move radially with respect to the piston rod under the effect of a pressure medium.

5. A winding machine as claimed in claim 4, in which the brake shoes are actuated by a pressure hose supplied with compressed air which is disposed at a side of the brake shoes remote from the piston rod of the thrust motor.

6. A winding machine as claimed in claim 2, in which said friction brake includes brake means shoes which move radially with respect to the piston rod under the effect of a pressure medium.

7. A winding machine as claimed in claim 6, in which the brake shoes are actuated by a pressure hose supplied with compressed air which is disposed at a side of the brake shoes remote from the piston rod of the thrust motor.

8. A winding machine for winding web material into a winding reel on a core, said winding machine comprising:

at least one roll supporting said winding reel;

a guide carriage connected to a respective end of the core of the winding reel;

thrust means for controlling line pressure between the winding reel and said roll, said thrust means including a thrust motor exerting force on the guide carriage;

dynamometer means for detecting line pressure between the winding reel and said roll, said dynamometer means being connected between the thrust motor and said guide carriage; and friction brake means for damping vibrations of the winding reel, said friction brake means acting on said thrust motor;

said thrust motor including a piston and cylinder, said friction brake means acting on the piston rod of the thrust motor, and said dynamometer means being constructed as a force measurement device disposed on said guide carriage, with the piston rod of said thrust motor acting on the force measurement device;

said friction brake means including brake shoes which move radially with respect to the piston rod under the effect of a pressure medium.

* * * * *